US012096853B1

(12) United States Patent
Bahnson

(10) Patent No.: US 12,096,853 B1
(45) Date of Patent: Sep. 24, 2024

(54) STABILIZING A TABLE

(71) Applicant: David Hastings Bahnson, Mendon, VT (US)

(72) Inventor: David Hastings Bahnson, Mendon, VT (US)

( * ) Notice: Subject to any disclaimer, the term of this patent is extended or adjusted under 35 U.S.C. 154(b) by 0 days.

(21) Appl. No.: 18/390,394

(22) Filed: Dec. 20, 2023

(51) Int. Cl.
*A47B 91/02* (2006.01)
*A47B 13/02* (2006.01)

(52) U.S. Cl.
CPC ..... *A47B 91/022* (2013.01); *A47B 13/023* (2013.01); *A47B 2013/024* (2013.01); *A47B 2013/025* (2013.01)

(58) Field of Classification Search
CPC ..... A47B 91/022; A47B 13/023; A47B 2014/024; A47B 2014/025
See application file for complete search history.

(56) References Cited

U.S. PATENT DOCUMENTS 2,103,202 A 10/1933 Green
2,857,707 A 1/1956 Caioli
5,249,767 A 10/1993 Mellen
5,533,457 A 7/1996 Cox
5,690,303 A * 11/1997 Winters ..... A47B 91/00 248/188.7
5,944,291 A * 8/1999 Kato ..... B60B 33/0068 248/188.8
6,009,815 A 1/2000 Hartman
6,186,453 B1 2/2001 Redbone
6,283,047 B1 9/2001 Haller(-Hess)
7,240,886 B2 * 7/2007 Jones ..... F16M 7/00 248/161
7,677,524 B2 3/2010 Brooke
7,930,980 B2 4/2011 Brooke
8,328,149 B2 12/2012 McLaughlin
8,607,715 B2 * 12/2013 Catoni ..... F16M 7/00 108/150
8,651,441 B2 * 2/2014 Brooke ..... A47B 91/16 108/153.1
8,876,071 B2 11/2014 Brooke
8,997,662 B2 * 4/2015 Heyring ..... F16M 7/00 108/115
9,414,676 B1 8/2016 Rafii
9,416,483 B1 8/2016 Freakes
9,635,939 B2 5/2017 Taylor
9,833,071 B2 12/2017 Heyring et al.
D815,477 S 4/2018 Molteni
(Continued)

FOREIGN PATENT DOCUMENTS

DE 3342169 A1 5/1985
DE 202010001659 U1 8/2010
(Continued)

*Primary Examiner* — Anita M King
(74) *Attorney, Agent, or Firm* — Paul Frank + Collins P.C.

(57) ABSTRACT

A table stabilizing device is configured to remedy wobble of a tabletop on a table. These configurations may include a slider that attaches or secures to a table leg of the table. The slider may have wedge W that interposes between the table leg and the floor. An end user can move the slider to change the position of the wedge W relative to the table leg, thus raising or lowering the table leg to stabilize the table. On a pedestal table with multiple legs, this feature will distribute weight across the other table legs.

20 Claims, 14 Drawing Sheets

(56) References Cited

U.S. PATENT DOCUMENTS

| | | | | |
|---|---|---|---|---|
| 10,130,174 | B2 | 11/2018 | Perrin | |
| 10,660,438 | B2 | 5/2020 | Hognaland et al. | |
| 11,457,740 | B2 | 10/2022 | Giery | |
| 2003/0230681 | A1 | 12/2003 | Gwynneth | |
| 2006/0054065 | A1 | 3/2006 | Gild | |
| 2008/0087777 | A1* | 4/2008 | Christian | A47B 91/00 248/188.8 |
| 2009/0183653 | A1* | 7/2009 | Brooke | A47B 13/023 248/188.7 |
| 2010/0071599 | A1 | 3/2010 | McEntire | |
| 2012/0048153 | A1 | 3/2012 | MacArthur-Onslow | |
| 2012/0152156 | A1 | 6/2012 | Watson | |
| 2012/0193503 | A1 | 8/2012 | Pike | |
| 2012/0241568 | A1 | 9/2012 | Christian et al. | |
| 2013/0112821 | A1 | 5/2013 | Brooke | |
| 2020/0022494 | A1 | 1/2020 | Paul | |
| 2021/0337963 | A1 | 11/2021 | Harvard et al. | |
| 2022/0071384 | A1 | 3/2022 | Giery | |

FOREIGN PATENT DOCUMENTS

| | | | |
|---|---|---|---|
| DE | 202020004179 | U1 | 11/2020 |
| EP | 3536191 | A1 | 9/2019 |
| EP | 4066686 | A1 | 10/2022 |
| GB | 394848 | | 7/1933 |
| WO | 2008011673 | A1 | 1/2008 |
| WO | 2009021250 | A2 | 2/2009 |
| WO | 2016081986 | A1 | 6/2016 |
| WO | 2019063720 | A1 | 4/2019 |

* cited by examiner

STABILIZING A TABLE

BACKGROUND

Many restaurants offer pedestal tables for patrons to enjoy meals and beverages. Ideally, these tables provide diners with a tabletop that is stable or steady, or otherwise free of any movement that might frustrate the meal, for example, by causing beverages to tip or spill. But stability of a table is often subject to myriad of factors. Uneven surfaces or ground warping, however small, may translate into significant "wobble" in the tabletop. This is particularly true at outdoor venues, but also common on any surface. Leveling feet or "glides" that are threaded and adjustable are meant to address these factors tend to offer only limited relief, if any at all. These devices are cumbersome to use because staff typically need to remove items from the tabletop and then turn the table on its side simply to raise or lower the position of the glide. Likewise, staff usually have few options to move the table because of space constraints, particularly at busy, popular restaurants that take full advantage of their footprint. Other solutions to this problem, like placing matchbooks, napkins, wedges, or other "fixed" objects, not only fail to adequately stabilize the table, but also cannot accommodate changes staff may make to re-position tables across the footprint of the restaurant.

SUMMARY

The subject matter of this disclosure relates to improvements to address wobble in tables, among other work surfaces. Of particular interest are embodiments that utilize a moveable wedge to raise or lower a table leg. These embodiments may include devices that secure to the table leg, or table generally, to make it easy for the device to move or reposition with the table. A benefit of the design is that the device is readily accessible for staff (or diners) to use to stabilize the table in a short amount of time and without the need to remove items from the tabletop. The device may reside within the table leg, generally out of sight of patrons. In one implementation, the embodiments may utilize a linkage, or flexible member, that allows the moveable wedge to remain flat on the floor. This feature provides a solid load bearing surface between the moveable wedge and the floor.

DRAWINGS

This specification refers to the following drawings.

Figure 1:
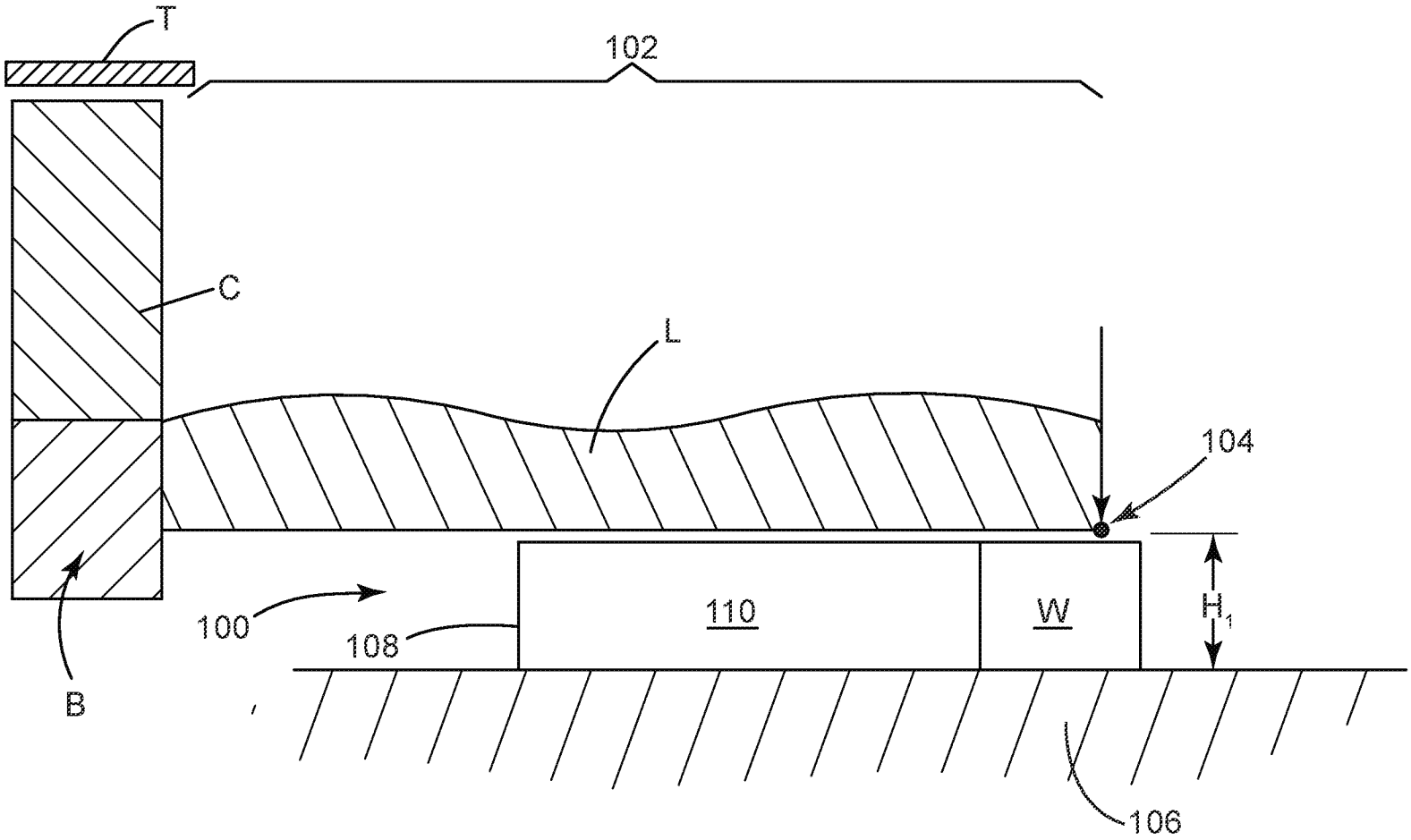
FIG. 1 depicts a schematic diagram of an exemplary embodiment of a table stabilizing device.

These drawings and any description herein represent examples that may disclose or explain the invention. The examples include the best mode and enable any person skilled in the art to practice the invention, including making and using any devices or systems and performing any incorporated methods. The drawings are not to scale unless the discussion indicates otherwise. Elements in the examples may appear in one or more of the several views or in combinations of the several views. The drawings may use like reference characters to designate identical or corresponding elements. Methods are exemplary only and may be modified by, for example, reordering, adding, removing, and/or altering individual steps or stages. The specification may identify such stages, as well as any parts, components, elements, or functions, in the singular with the word "a" or "an;" however, this should not exclude plural of any such designation, unless the specification explicitly recites or explains such exclusion. Likewise, any references to "one embodiment" or "one implementation" does not exclude the existence of additional embodiments or implementations that also incorporate the recited features.

DESCRIPTION

The discussion now turns to describe features of the examples shown in the drawings noted above. These features address problems with stability of tables, for example, tables found in restaurants or eateries. The embodiments herein introduce designs that can eliminate wobble at the tabletop to allow diners to enjoy their meal. These designs also prevent movement of beverages, which often are likely to tip or spill due to even slight wobble of the tabletop. Other embodiments are contemplated within the scope of this disclosure.

FIG. 1 depicts a schematic diagram of an example of a table stabilizing device 100. This example may incorporate into a table assembly 102, shown here with a center post or "pedestal" C with an end that supports a tabletop T and another end with a base B disposed thereon. The table assembly 102 may also have a table leg L with a load bearing point 104 that requires adjustment relative to a surface 106. As shown, the table stabilizing device 100 may have a body 108 that forms an adjustment 110 with a wedge W that can interpose between the load bearing point 104 and the surface 106 to change a height $H_1$ therebetween.

Broadly, the table stabilizing device 100 may be configured to provide end users with a simple solution to table wobble. These configurations may include devices that the end user can actuate with their foot. This feature may alleviate side-to-side rocking, among other issues, that can translate to wide swings or wobble in the tabletop T. A benefit of the design is that it can stabilize the table without the need to displace the table from its position in a restaurant, a home, or like location or establishment.

The table assembly 102 may be configured to provide an operative surface that an end user may utilize for dining, work, or the like. These configurations may include designs of various shapes or sizes. The designs may use different arrangements of the table base B. A pedestal table, for example, may have multiple table legs L, for example, three or four, that extend or radiate outwardly from the pedestal C. The table stabilizing device 100 may adjust the height $H_1$ of one of the table legs relative to the surface 106, like carpet, tile, wood, or other floor covering. The table stabilizing device 100 is amendable for outdoor use, as well, where the surface 106 may feature brick, cobblestone, cement or concrete, decking, and the like.

The body 108 may be configured to fit in proximity to the table leg L. These configurations may include devices with a stabilizing mechanism that is easy to assemble into the table assembly 102 and operate by an end user. In one implementation, the device may incorporate within the structure of the table leg L. An exposed portion or "actuator" of the device may permit the end user to acuate the mechanism to cure any wobble or instability in the table assembly 102. The mechanism may require parts of the table assembly 102, for example the table leg L, to include features like slot(s) or hole(s) to provide the end user with access to the actuator. However, this disclosure also contemplates that the mechanism may find use to stabilize the operative surface without any modifications to the table assembly 102.

The adjustment 110 may be configured to change the position of the wedge W relative to the load bearing point 104. These configurations may include devices that incorporate degrees of freedom, like pivots, to ensure appropriate locations for the wedge W. The pivots may allow parts of the device to move or rotate relative to other parts. This feature may distribute weight of the table leg L (and the table assembly 102 generally) in a manner that allows the wedge W to move more freely. It may also prevent deformation of the wedge W as the wedge W translates relative to the load bearing point 104.

Figure 2:
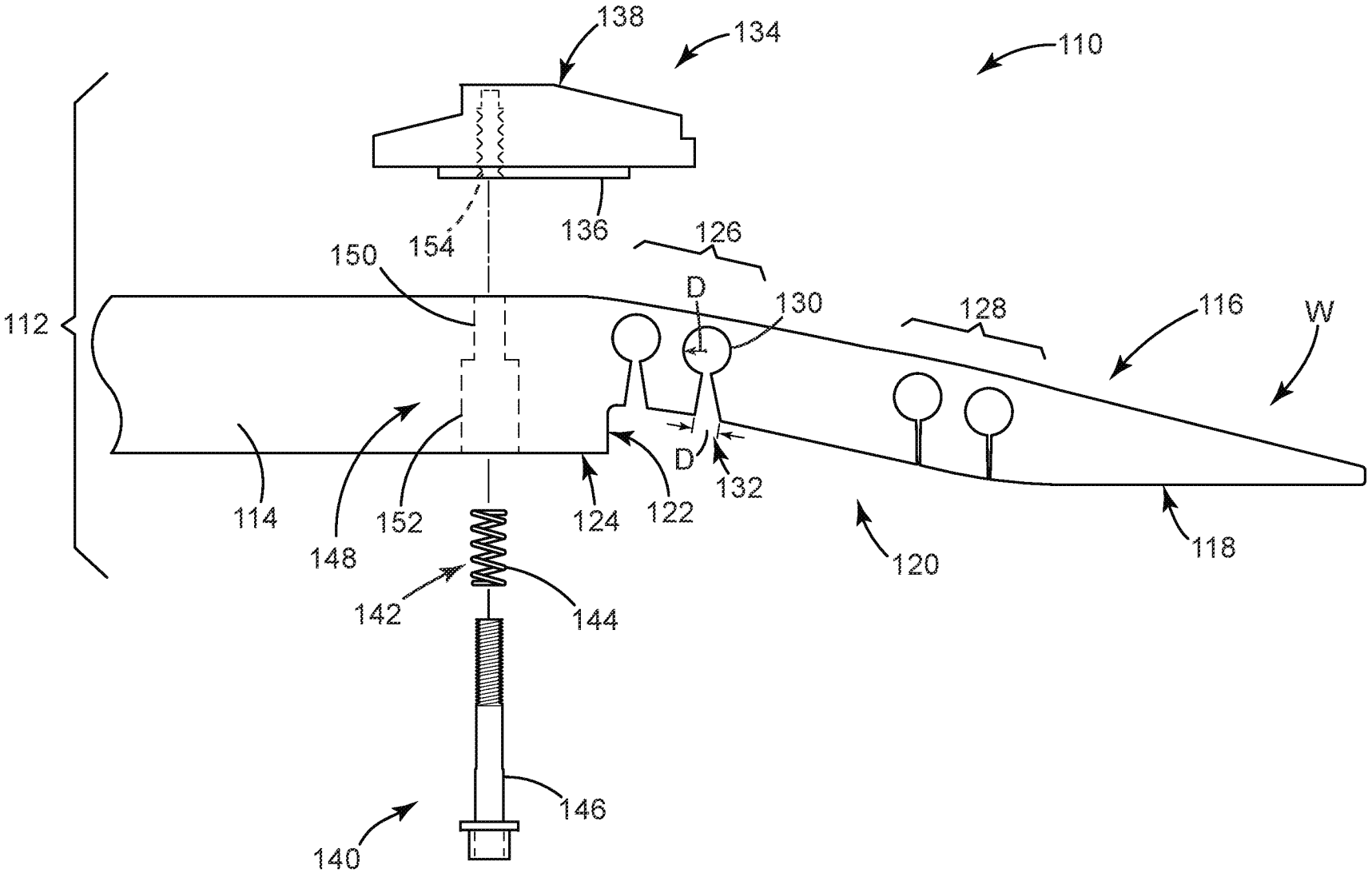
FIG. 2 depicts an elevation view from the side of an example of the table stabilizing device of FIG. 1 in exploded form.

FIG. 2 depicts an elevation view from the side of exemplary structure for the table stabilizing device 100 of FIG. 1. The adjustment 110 may include a slider 112 that has a monolithic body 114 that may comprise materials with properties that allow it to flex or bend under load. These materials may also reduce friction to allow the wedge W to slide over the surface 106 more easily. Examples of materials may include ultra-high weigh polyethylene (UHWPE) or rubber, although this disclosure contemplates other materials, compositions, combinations with similar properties may prevail as well. Coatings on one or more surface of the body 114 may also aid in the design. At its distal end, the top of the body 114 may have a tapered or inclined portion 116 that forms the wedge W. The portion 116 may have a surface that is smooth; however, as noted herein, this surface may include ridges, grooves, or other non-smooth features. The bottom may have a sliding or contact portion 118 below at least part of the inclined portion 116. A recess portion 120 may terminate at a shoulder 122 to form a heel portion 124 at the proximal end of the body 114. Slots 126, 128 may penetrate laterally from side-to-side of the body 114. In one implementation, the lateral slots 126, 128 may have geometry that can deform to allow the the slider 112 to change configuration. This geometry may include an aperture 130, shown here with a shape that is round or annular. A groove 132 may extend from the recess portion 120 of the body 114 to the aperture 130. Notably, the features 130, 132 may have a dimension D that corresponds with, for example, the radius of the aperture 130 or the width of the groove 132. Movement of the slider 112 may cause the dimension D to change concomitantly with the height $H_1$ of the load bearing point 104.

The slider 112 may also include features to enhance operability of the device. In one implementation, the slider 112 may include a knob 134 with a bottom side that has a protrusion or "keel" 136 to prevent rotation of the knob 134. On its top side, the knob 134 may have an engagement portion 138 with geometry to accommodate operation of the stabilizing device 100 by the end user. The device may also benefit from a tension mechanism 140 that can secure the knob 134 to the body 114. This device may also create a "clamping" force therebetween. In one implementation, the tension mechanism 140 may embody a "resilient" device 142 with a spring 144, shown here as a coil spring. This disclosure also contemplates use of flat springs, spring washers, or similar devices in the resilient device 142 as well. The coil spring 144 may fit or insert onto a bolt 146. The slider 112 may include a mounting location 148 for the resilient device 142. For example, the parts 144, 146 may insert into a hole 150 (shown here with a counter-bore 152) in the body 114. The bolt 146 may engage with threads in a threaded hole 154 in the knob 134. In one example, a lock washer or lock nut may find use to prevent the bolt 146 from backing out of the threaded hole 154.

Figure 3:
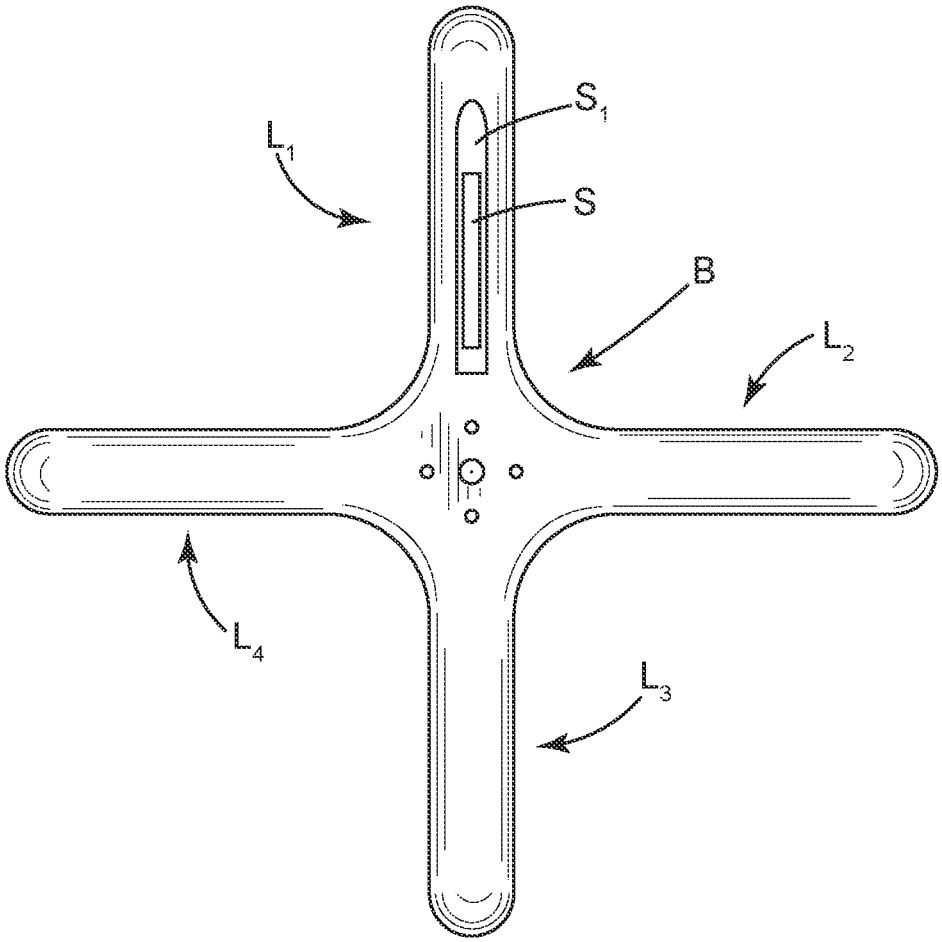
FIG. 3 depicts a plan view from the top of an example of a table base.
Figure 4:
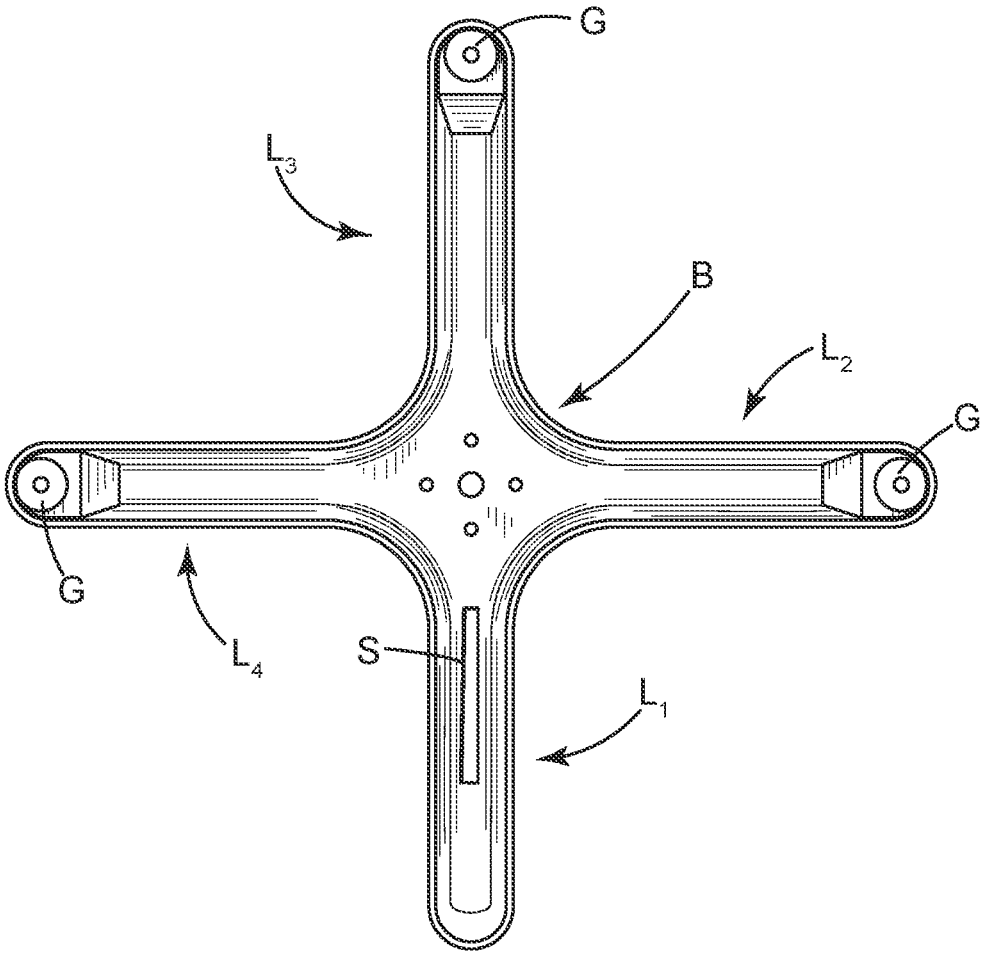
FIG. 4 depicts a plan view from the bottom of the table base of FIG. 3.

FIGS. 3 and 4 depict an example of a base B for use with the slider 112 of FIG. 2. FIG. 3 depicts a plan view from the top of this example, which embodies a "crisscross" style with four table legs ($L_1$, $L_2$, $L_3$, $L_4$). In one implementation, a slot S penetrates through table leg $L_1$. The slot S may have a length that allows appropriate travel of the body 114, as between the pedestal C and the load bearing point 104 at the end of table leg $L_1$. The base B may also have a counter-bore slot $S_1$ that extends along the length of the slot S. As best shown in FIG. 4, adjustable stabilizing feet or "glides" G may insert into ends of table legs $L_2$, $L_3$, $L_4$. An end user can set or fix the position of these glides so that the bottom of the glides G establishes a fixed "resting" plane. In use, table legs $L_2$, $L_3$, $L_4$ form a stable tripod, which is made unstable if the surface 106 is not level because of the relationship between the glides G and the center post C. The slider 112 addresses this instability because it adjusts the height $H_1$ of table leg $L_1$ to be above or below the resting plane. Notably, this disclosure contemplates that the slider 112 and the wedge W may reside in different table legs, for example, wherein wedge W resides in table leg $L_1$ and the slider resides in table leg $L_3$.

Figure 5:
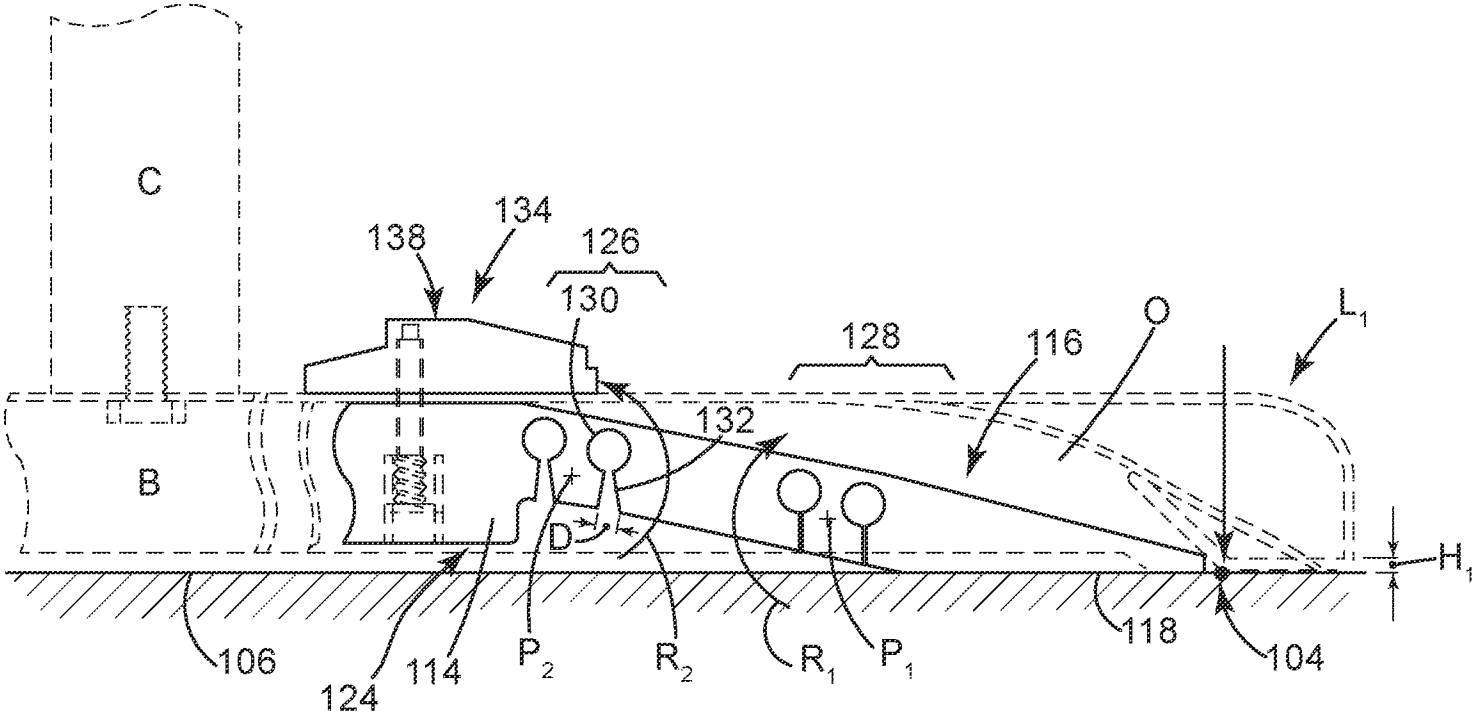
FIG. 5 depicts an elevation view from the side of a cross-section of the table base of FIG. 3 with the table stabilizing device of FIG. 2 therein.

FIG. 5 depicts an elevation view of a partial cross-section of the base B of FIGS. 3 and 4 that includes the slider 112 discussed above. The body 114 may reside inside of table leg $L_1$, for example, within a hollow opening O that results from manufacture of the table assembly 102. The keel 136 may extend through the slot S to engage with the body 114 to prevent rotation of the knob 134. The bottom side of the knob 134 may fit into the counter-bore slot $S_1$. The resilient device 142 is in place to attach or secure the body 114 and the knob 134 together. This feature may allow the clamping force to clamp portions of the table leg $L_1$ between the top of the body 114 and the bottom of the knob 134.

The slider 112 is shown in a first or "disengaged" position. This position may correspond with a first configuration for the slider 112. The inclined portion 116 does not interpose between the load bearing point 104 and the surface 106.

Lateral slots 126, 128 exhibit a first value for dimension D in this first position. In use, an end user may engage the engagement portion 138 of the knob 134 to "push" or "pull" the body 114 with their foot or hand. This action may cause the body 114 to transit within the hollow opening O, preferably in positions along the length of the table leg $L_1$. These positions may interpose the inclined portion 116 between the load bearing point 104 on the table leg $L_1$ and the floor 106.

Figure 6:
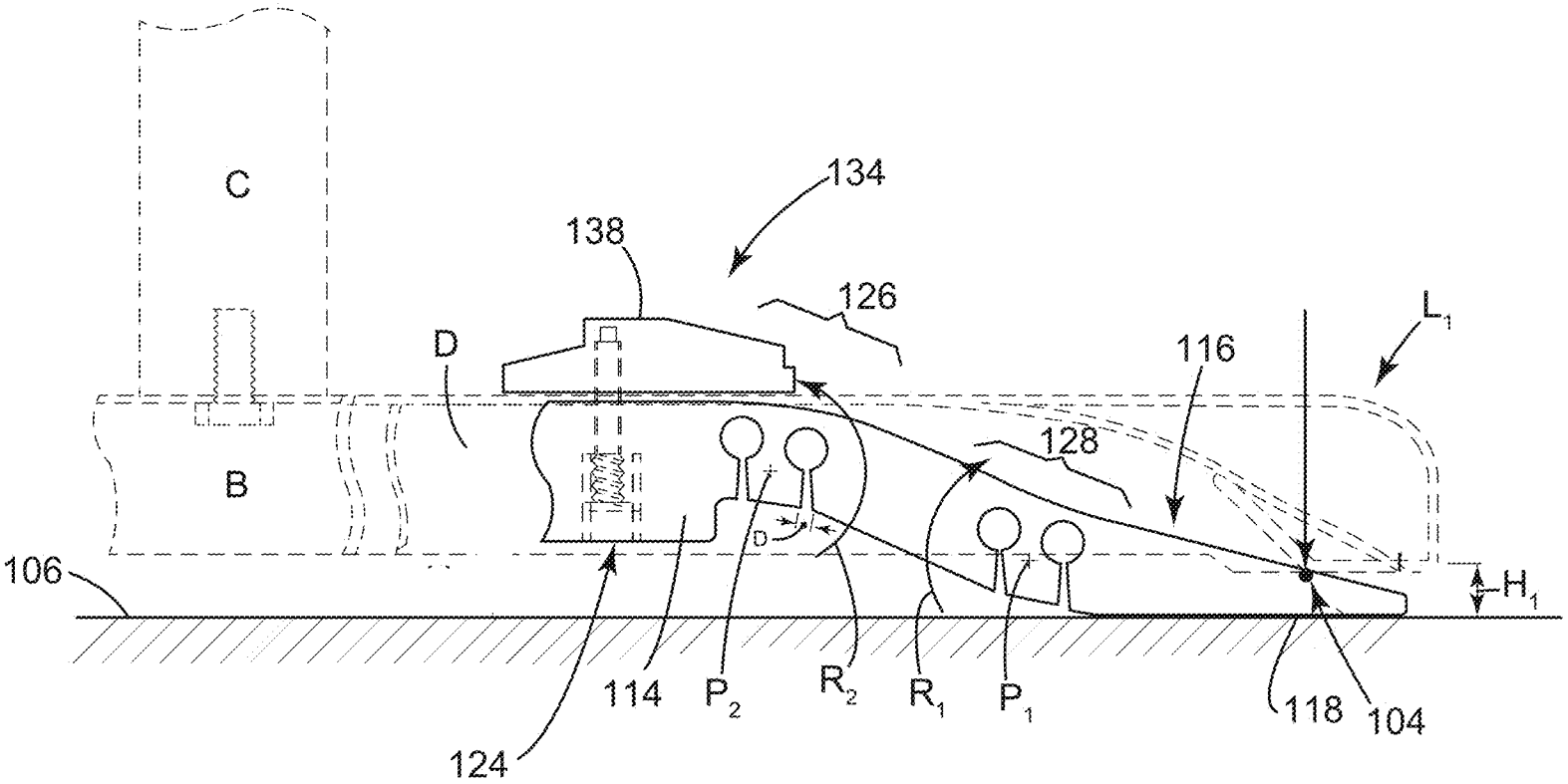
FIG. 6 depicts the cross-section of the table base of FIG. 5.

FIG. 6 shows the slider 112 of FIG. 4 in a second or "engaged" position, where the inclined portion 116 contacts the load bearing point 104 of table leg $L_1$ at a contact point. This position sets the height $H_1$ of table leg $L_1$ off the floor 106, stabilizing the base B. The clamping force of the tension mechanism 140 operates as a "friction brake" to maintain the wedge W in its position below the load bearing point P. Without this brake, the wedge W may back out of its position due to the weight of the table at contact point.

As noted, changing the position of the slider 112 will stabilize the tabletop T. "Pulling" the slider 112 towards the load bearing point 104 of the table leg $L_1$, or away from the pedestal C, will move the contact point up the inclined portion 116 and further increase the height $H_1$. On the other hand, "pushing" the slider 112 away from the load bearing point 104 of the table leg $L_1$, or towards the pedestal C, will move the contact point down the inclined portion 116 and decrease the height $H_1$. Notably, lateral slots 126, 128 have a second value for dimension D in this second position of the slider 112 that is different (and less than) the first value in the first position of the slider 112 noted above. This feature creates pivots $P_1$, $P_2$ with axis $R_1$, $R_2$ about which the body 114 flexes or "rotates" to allow the heel portion 124 to move relative to the contact portion 118. This feature also changes the configuration of the slider 112 from its first configuration to a second configuration. In one implementation, the heel portion 124 will move higher or lower relative to the floor 106 in response to the direction of travel of the slider 112. The contact portion 118 remains in contact with the floor 106.

Figure 7:
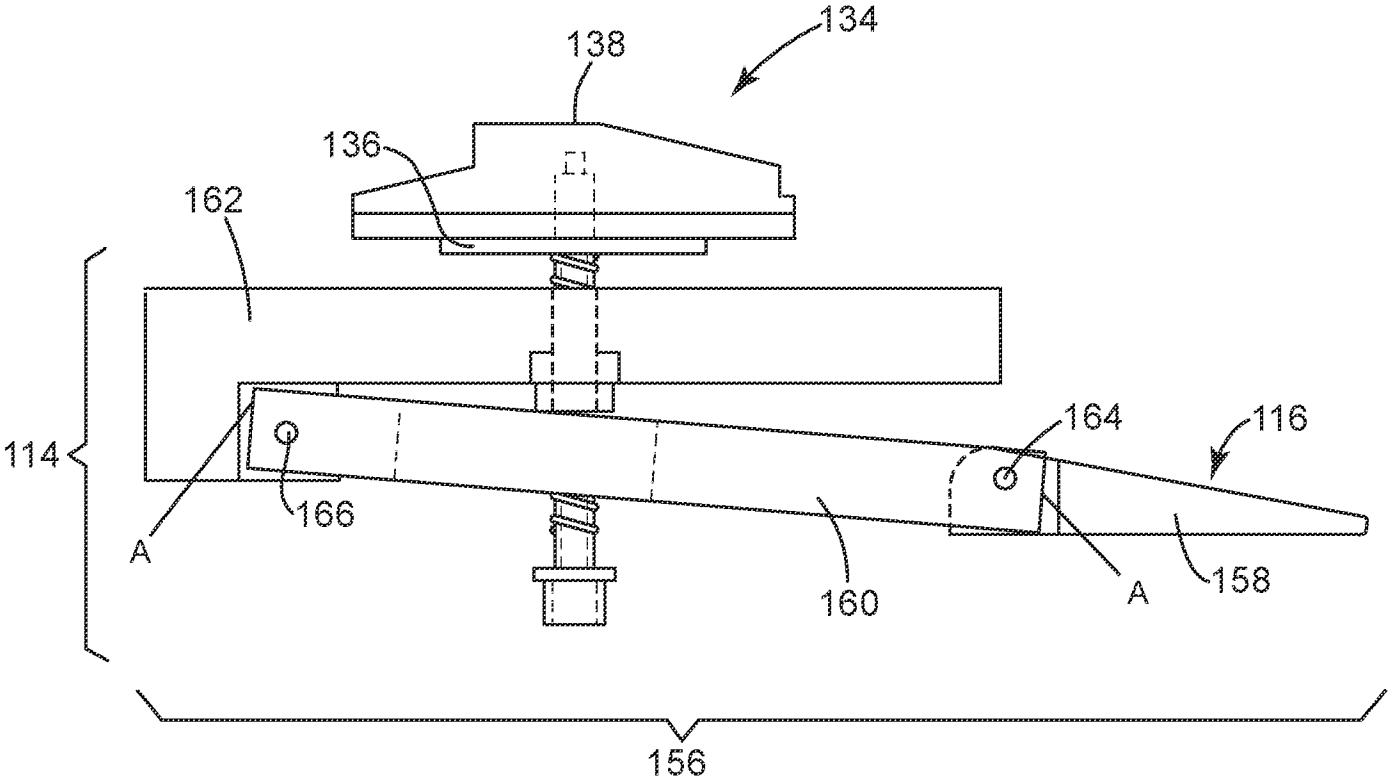
FIG. 7 depicts an elevation view from the side of an example of the table stabilizing device of FIG. 1 in partially-exploded form.

FIG. 7 also depicts an elevation view of exemplary structure for the table stabilizing device 100 of FIG. 1. The body 114 may embody a linkage 156 with a first linkage 158 that incorporates the inclined portion 116. A second linkage 160 may secure to the first linkage 158 at one end. Its other end may secure to a third linkage 162. Pins 164, 166 may find use to secure the linkages 158, 160, 162 together. The linkages 158, 160, 162 may incorporate features, preferably on the ends, that act or form hard stops A. These features may prevent prevents the device from falling out or "sagging" from the bottom of the table leg $L_1$, which might occur when an end user picks the table up to move it from one position to another.

Figure 8:
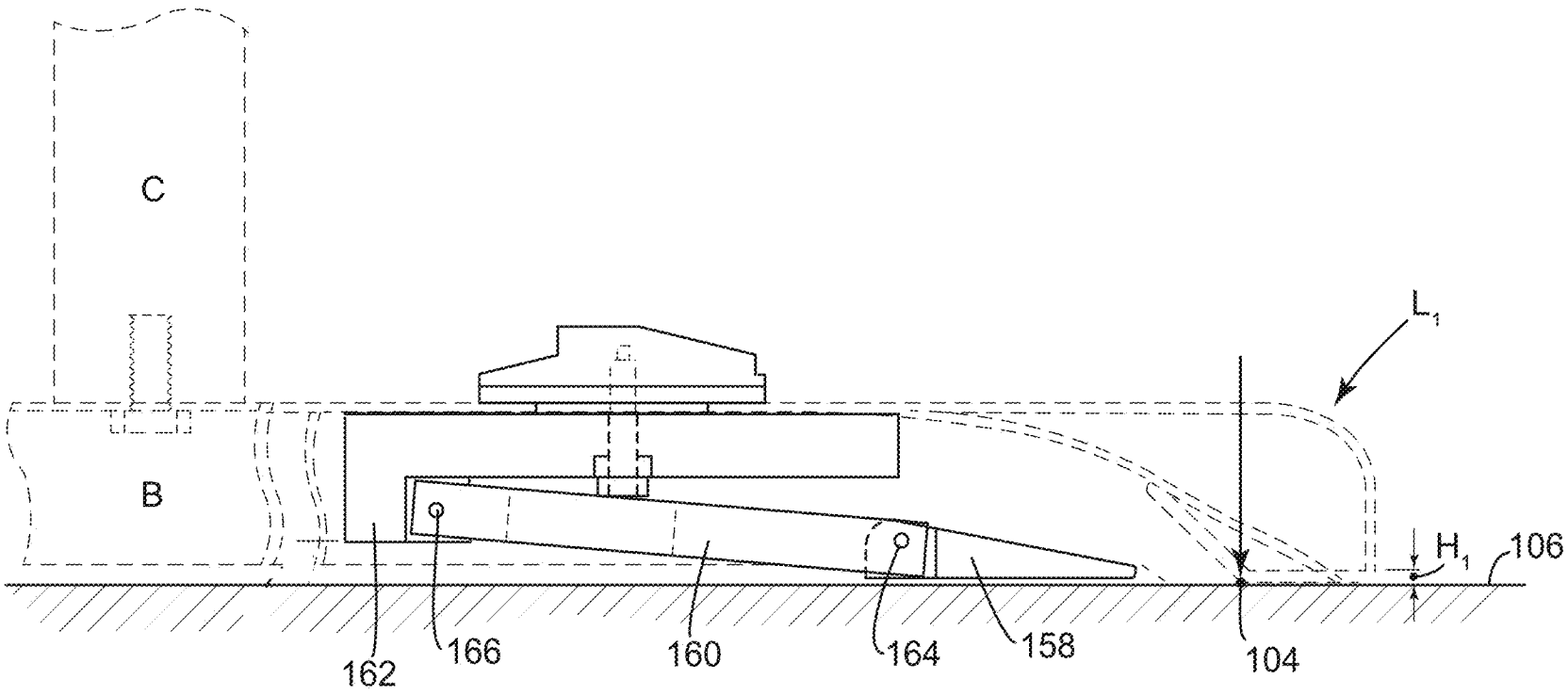
FIG. 8 depicts an elevation view from the side of a cross-section of the table base of FIG. 3 with the table stabilizing device of FIG. 7 therein.
Figure 9:
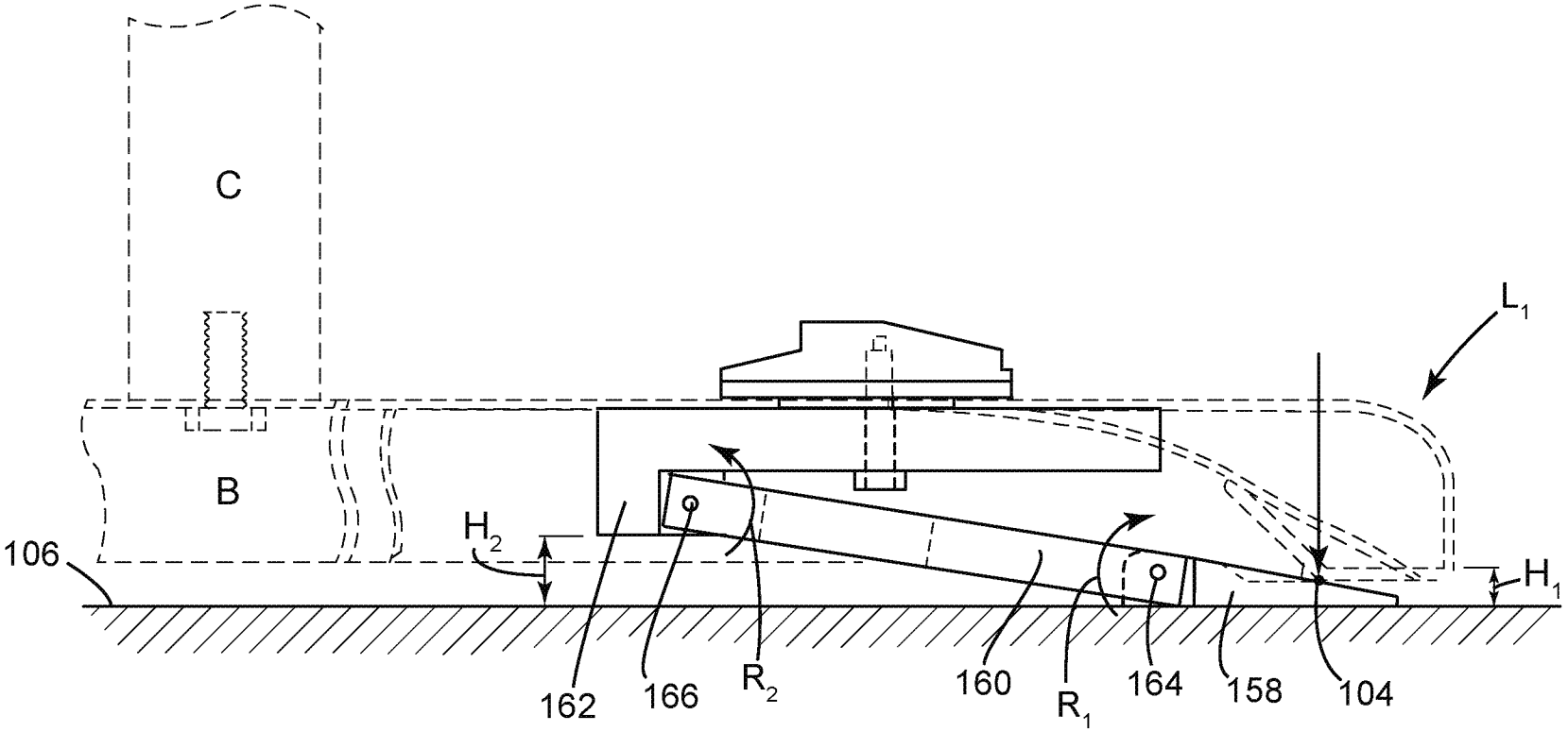
FIG. 9 depicts the cross-section of the table base of FIG. 7.

FIGS. 8 and 9 depict an elevation view of a partial cross-section of the base B of FIGS. 3 and 4 with the structure of FIG. 7 resident therein. The linkage 156 may reside inside of the hollow opening O of the table leg $L_1$. The keel 136 may extend through the slot S in the table leg $L_1$ to engage with the third linkage 162. As noted above, the bottom side of the knob 134 may fit into the counter-bore slot $S_1$. This feature may allow the clamping force to clamp portions of the table leg $L_1$ between the parts 134, 162. In use, the end user may "push" or "pull" the knob 134 to translate the linkage 162. This action may cause the linkage 162 to change position to locate the inclined portion 116 of the first linkage 158 below the unbalanced end of the table leg $L_1$. Notably, the linkage 158, 160, 162 also facilitates use of the table stabilizing device 100 because the pins 164, 166 create the axis $R_1$, $R_2$ about which the ends of the second linkage 160 rotate relative to the first linkage 158 and the third linkage 160. This feature permits the second end of the second linkage 160 to move higher and lower relative to the floor 106 in response movement of the slider 114. On the other hand, the first end of the second linkage 160 remains at relatively the same, which maintains the sliding portion 118 on the floor 106, even as it moves back and forth along the table leg $L_1$. The axis $R_1$, $R_2$ may also allow the linkage 158, 160, 162 to change configuration for example, between its first configuration (FIG. 8) and second configuration (FIG. 9).

Figure 10:
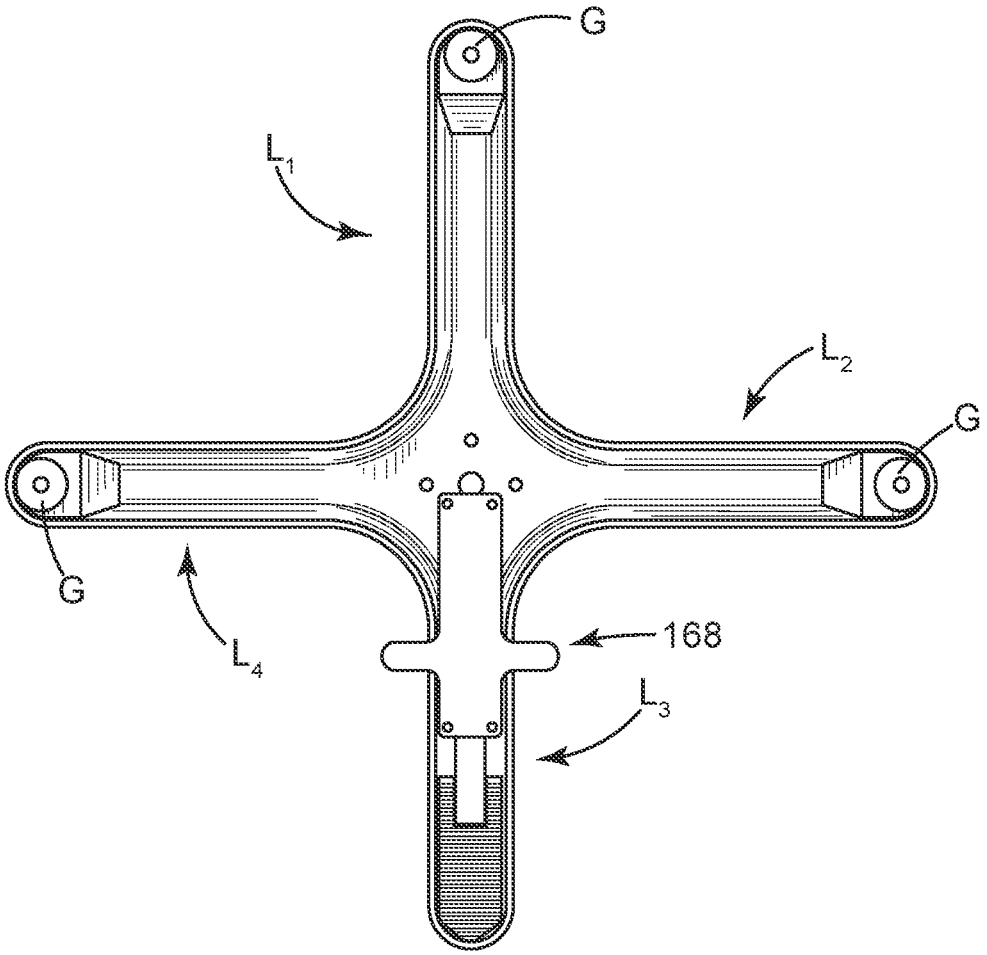
FIG. 10 depicts a plan view from the bottom of an example of the stabilizing device of FIG. 1 in a table base.
Figure 11:
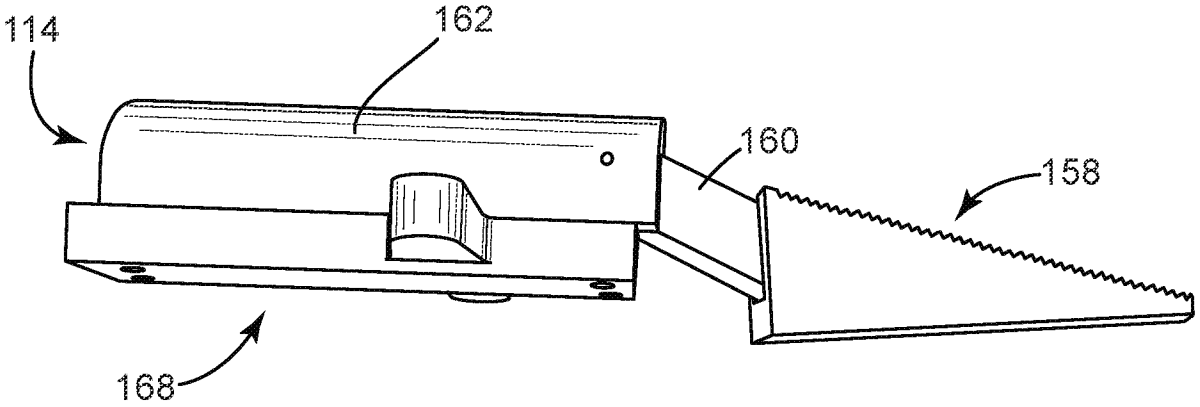
FIG. 11 depicts a perspective view from the side of the table stabilizing device of FIG. 10.
Figure 12:
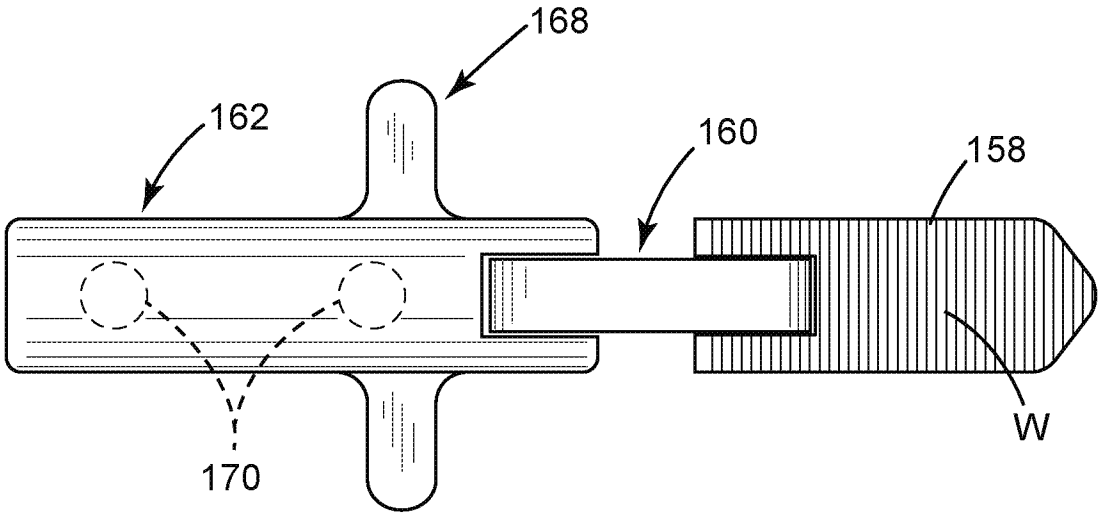
FIG. 12 depicts a plan view from the top of an example of the table stabilizing device of FIG. 11.

FIGS. 10, 11, and 12 depict exemplary structure for the table stabilizing device of FIG. 1. The device may include an armature 168 that extends peripherally from the sides of the body 114. The armature 168 may take the place of the knob 134 (FIG. 5). This feature does not require any modifications to the table leg $L_1$ because the armature 168 is accessible outside of the table leg $L_1$, for example, on either side of the table leg $L_1$. As best shown in FIG. 11, the armature 168 may attach to the slider 114, for example, to the bottom of the third linkage 162. Fasteners like screws may help for this purpose. In one example, the armature 168 and the third linkage 162 may integrate together as a single, unitary structure or piece. FIG. 12 show a plan view from the top of the structure. Magnets 170 may help secure the slider 114 into the table leg $L_1$. The magnets 170 also provide friction to maintain the wedge in place under the load bearing point 104. As noted herein, this feature avoids the tendency of the weight of the table to "squeeze" the wedge W out of its position below the load bearing point 104.

Figure 13:
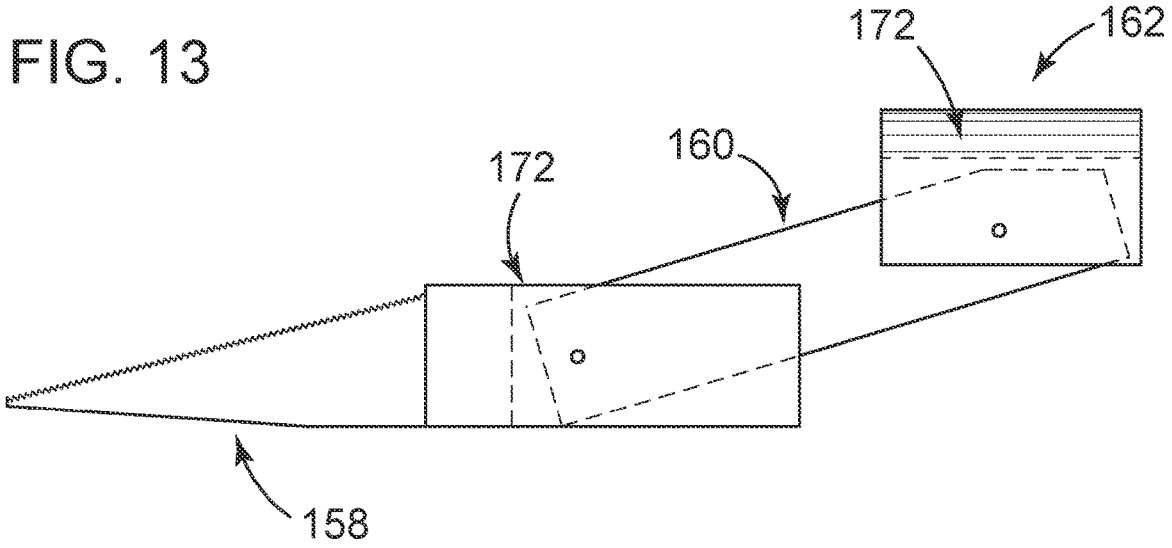
FIG. 13 depicts an elevation view from the side of an example of the table stabilizing device of FIG. 1
Figure 14:
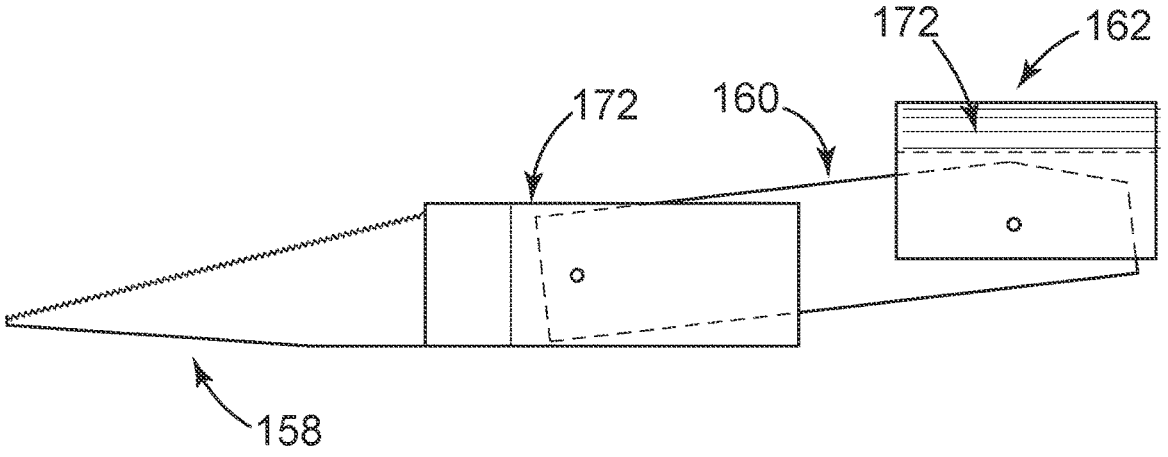
FIG. 14 depicts an elevation view from the side of the table stabilizing device of FIG. 13.
Figure 15:
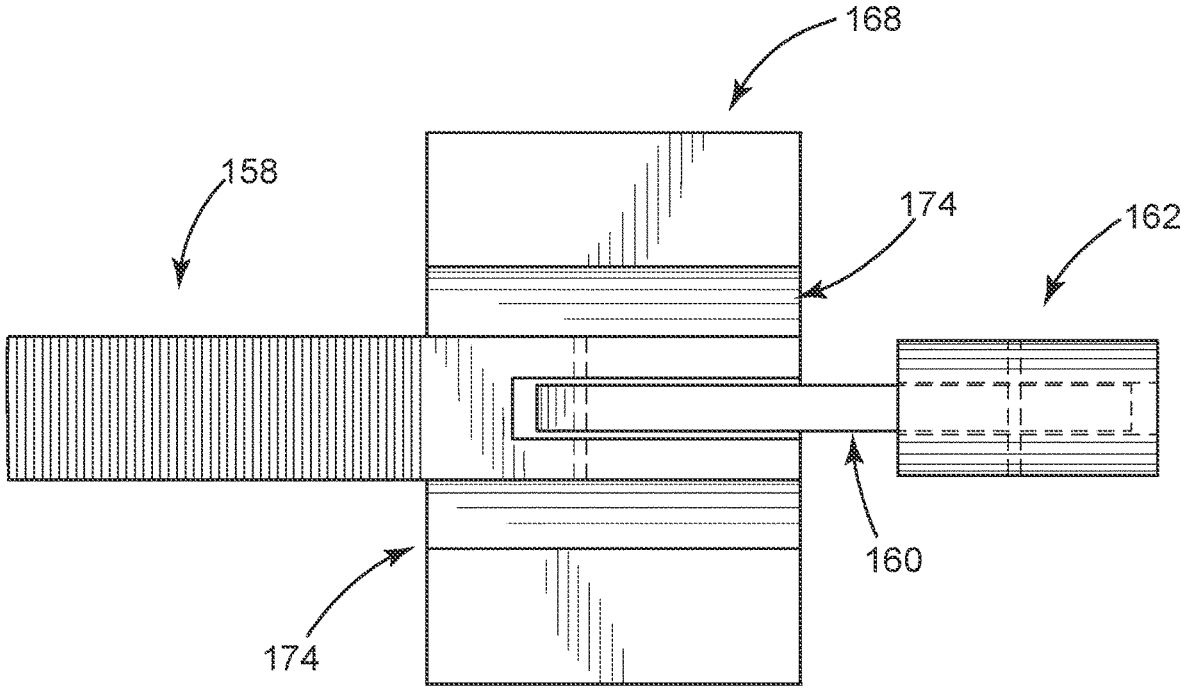
FIG. 15 depicts a plan view from the top of the table stabilizing device of FIG. 13.

FIGS. 13, 14, and 15 also depict exemplary structure for the table stabilizing device of FIG. 1. This structure may form hard stops 172, for example, areas of the linkages 158, 160, 162 that contact one another. As noted above, the hard stops 172 may prevent relative movement and prevent the device from falling out or "sagging" from the bottom of the table leg $L_1$, which might occur when an end user picks the table up to move it from one position to another. As best shown in FIG. 15, the armature 168 may include grooves 174 that accommodate side walls of the table leg $L_1$. These features are useful to allow the device to reside inside of the table leg $L_1$ to leave just actuating arms 176 accessible to the end user to move or slide the device back-and-forth within the table leg $L_1$.

The examples below include certain elements or clauses to describe embodiments contemplated within the scope of this specification. These elements may be combined with other elements and clauses to also describe embodiments. This specification may include and contemplate other examples that occur to those skilled in the art. These other examples fall within the scope of the claims, for example, if they have structural elements that do not differ from the literal language of the claims, or if they include equivalent structural elements with insubstantial differences from the literal language of the claims.

What is claimed is:

1. A table stabilizing device comprising:

a body that is configured to change from a first configuration to a second configuration about a pair of pivots that are spaced longitudinally apart from another, the body terminating at an end that has an inclined plane; and a friction brake coupled to the body, wherein the pair of pivots comprise lateral slots that extend from a first side to a second side of the body and about which the body flexes to change from the first configuration to the second configuration.

2. A table stabilizing device of claim 1, wherein the laterals slots comprise an annular hole and a groove that extend from a first side to a second side of the body.

3. The table stabilizing device of claim 1, wherein the friction brake is configured to couple with a table leg.

4. The table stabilizing device of claim 1, further comprising:

magnets disposed in the body.

5. The table stabilizing device of claim 1, further comprising:

a knob that couples on top of the body.

6. The table stabilizing device of claim 1, further comprising:

a knob; and a tension mechanism that couples the knob to the body, wherein the tension mechanism comprises a resilient member that generates a clamping force between the knob and the body to create the friction brake.

7. The table stabilizing device of claim 1, further comprising:

a knob;

a threaded bolt that penetrates through the body into the knob; and a coil spring disposed on the threaded bolt and resident in the body, wherein the coil spring generates a clamping force between the knob and the body to create the friction brake.

8. A table stabilizing device comprising:

a body that is configured to change from a first configuration to a second configuration about a pair of pivots that are spaced longitudinally apart from another, the body terminating at an end that has an inclined plane; and a friction brake coupled to the body, wherein the body comprises a first linkage that terminates at the inclined plane, a second linkage, a third linkage, and pins that connect a first end of the second linkage to the first linkage and a second end of the second linkage to the third linkage and about which the body rotates to change from the first configuration to the second configuration.

9. The table stabilizing device of claim 8, further comprising:

magnets disposed in the body.

10. The table stabilizing device of claim 8, wherein the friction brake is configured to couple with a table leg.

11. The table stabilizing device of claim 8, further comprising:

a knob;

a threaded bolt that penetrates through the body into the knob; and a coil spring disposed on the threaded bolt and resident in the body, wherein the coil spring generates a clamping force between the knob and the body to create the friction brake.

12. A table stabilizing device comprising:

a body configured to fit into hollow space within a table leg, the body having a distal end that forms an inclined plane;

a knob removeable from the body; and a tension mechanism securing the knob to the body, the tension mechanism configured to generate a clamping force between part of the knob and part of the body, wherein the tension mechanism comprises a bolt that penetrates the body and the knob and a coil spring that fits onto the bolt.

13. The table stabilizing device of claim 12, wherein the knob has a bottom with a protruding keel.

14. The table stabilizing device of claim 12, wherein the body comprises a flexible member.

15. The table stabilizing device of claim 12, wherein the body comprises a multi-piece linkage.

16. The table stabilizing device of claim 12, wherein the tension mechanism comprises a resilient member.

17. A pedestal table comprising:

a pedestal having a first end and a second end;

a tabletop coupled to the first end;

a base coupled to the second end, the base comprising table legs extending outwardly from the pedestal; and a table stabilizing device disposed on one of the table legs, the table stabilizing device comprising a body that fits inside of the leg and terminates in an inclined plane, wherein the table stabilizing device translates longitudinally in the table leg to change the position of the inclined plane relative to a load bearing point on the table leg, wherein the table stabilizing device comprises a friction brake that is configured to counter a load on the inclined plane at the load bearing point on the table leg.

18. The pedestal table of claim 17, wherein the table stabilizing device penetrates through a slot in the table leg.

19. The pedestal table of claim 17, wherein the table stabilizing device comprises a knob accessible outside of the table leg.

20. The pedestal table of claim 17, wherein the body is configured to rotate about a pair of pivots that are spaced longitudinally apart from one another.

* * * * *